US007596887B2

(12) United States Patent
McClellan

(10) Patent No.: US 7,596,887 B2
(45) Date of Patent: Oct. 6, 2009

(54) ORTHOPEDIC CORRECTIVE SANDAL OR SHOE

(76) Inventor: W. Thomas McClellan, 2680 Arbor Dr., Fort Lauderdale, FL (US) 33312

( * ) Notice: Subject to any disclaimer, the term of this patent is extended or adjusted under 35 U.S.C. 154(b) by 26 days.

(21) Appl. No.: 11/235,594

(22) Filed: Sep. 26, 2005

(65) Prior Publication Data

US 2007/0068038 A1 Mar. 29, 2007

(51) Int. Cl.
*A43B 3/12* (2006.01)

(52) U.S. Cl. ..... 36/11.5; 36/140

(58) Field of Classification Search ..... 36/11.5, 36/7.6, 140, 142, 143, 144
See application file for complete search history.

(56) References Cited

U.S. PATENT DOCUMENTS 900,881 A * 10/1908 Parker ..... 36/8.1
1,407,992 A * 2/1922 Doody ..... 36/11.5
4,124,946 A * 11/1978 Tomlin ..... 36/43
4,244,359 A 1/1981 Dietrich
4,263,902 A 4/1981 Dietrich
4,967,750 A 11/1990 Cherniak
5,423,134 A * 6/1995 Bagnaia et al. ..... 36/11.5
D374,338 S * 10/1996 Chuang ..... D2/961
5,592,757 A * 1/1997 Jackinsky ..... 36/114
5,787,608 A * 8/1998 Greenawalt ..... 36/11.5
5,836,090 A * 11/1998 Smith ..... 36/7.6
7,287,342 B2 * 10/2007 Keen ..... 36/50.1

* cited by examiner

*Primary Examiner*—Jila M Mohandesi
(74) *Attorney, Agent, or Firm*—Laurence A. Greenberg; Werner H. Stemer; Ralph E. Locher

(57) ABSTRACT

An orthopedic sandal or shoe to be worn intermittently with and to correct the effects of high heel shoe wear, includes a body with upper and lower surfaces. The upper surface provides equalized pressure support without concentration on the heel or balls of the foot and without arch support. A traction system provides first toe traction without foot rotation relative to the upper surface. A foot securing system is disposed at the upper surface. A heel support at the upper surface interacts with the foot securing system to eliminate toe gripping and strain. A descending slope or dome may be provided at the upper surface to support, spread and downwardly deflect the toes to reverse dorsal-flexing. An elevated forefoot angulation may be provided at the upper surface to stretch the plantar fascia and Achilles tendon. A rocker bottom may be provided only under the toe area of the lower surface.

19 Claims, 10 Drawing Sheets

ORTHOPEDIC CORRECTIVE SANDAL OR SHOE

BACKGROUND OF THE INVENTION

1. Field of the Invention

The invention relates to an orthopedic sandal or shoe which corrects the foot problems caused by chronic high heel wear, and because it does not require the wearer to refrain from high heel wear, becomes an acceptable therapy to the wearer.

The wearing of high heel shoes is almost obligatory, considering custom, fashion, appearance and business attire requirements. High heels are worn to enhance the female "look". The foot looks smaller, the ankle more trim, the calf and legs more curvaceous. The legs appear longer and the buttocks is tilted out. The female is taller, appears thinner and younger, and the stride more feminine. The advantages are so impressive, that these shoes become very addictive to the wearer and just as destructive.

In normal anatomy, the rounded heel rolls forward, sharing the weight with the lateral foot, which pronates, spreading the pressures evenly along the forefoot to the large toe, which contracts gently, propelling the walker into the next stride.

The classic high heel shoe, forward tilts the ankle and foot, distorting the anatomy and compressing the forefoot and toes. The heels' distorted position prevents normal pressure absorption and unloads the weight suddenly while still several inches from the ground. These non-distributed high pressures are then concentrated on the very small bony surfaces of the balls of the feet. The metatarsal junction is also held in a hyperflexed position by the high heel, making it even less able to tolerate the focused pressures. The forefoot and toes are then forced into a funnel-shaped narrowing, compressing the forefoot with additional lateral loads, on top of the vertical loads. The first toe is forced against and over the second toe. The third is abraded against the fourth and the fifth is crammed under the fourth.

Chronic high heel wear pathologies include: halux valgus, hammertoe, bunions, neuromas, contracture of the plantar fascia, heel spurs, contusions of the metatarsals, acute and chronic pain.

2. Description of the Related Art

The only presently available treatment is to stop wearing high heels and wear broad toed, low heel "granny" shoes. This makes the wearer look short, fat, plain and years older. Wearer acceptance and compliance is almost zero.

U.S. Pat. No. 4,967,750 discloses a modular orthopedic sandal or shoe having an orthopedic appliance attached to a sole, between an insole and a top surface of the sole. The sole has a transverse channel and a central member attached to the sole within the channel. An arch strap is connected to the sole at the top of the central member within the channel. The arch strap encircles the foot to attach the sole to the foot. The arch strap is inelastic and decreases the flexibility of the sole for increased support for the arch of the foot. That device provides arch support, rather than therapy for the maladies associated with high heel wear.

U.S. Pat. No. 4,263,902 relates to an orthopedic sandal or shoe for correction of hammertoe and halux valgus. A dual lever arm has a pressure element or curvature plate on one arm for pressing the joints of the toes downward and the other arm is fastened to a rearward portion of the foot so that as the foot is lifted, the pressure element is pressed downwardly on the hammertoes. A strap loop can be pulled by the movement of the pressure element. A hydraulic pneumatic system actuated by the pressure element can push on the halux valgus. An elastic resilient member can push the halux valgus. A mechanical mechanism can be actuated by foot pressure on a flexible pad in the sole. The pressure on the hammertoes can be adjusted depending on the fulcrum point of the lever arm. The pressure on the halux valgus can be continuous with augmentation whenever the lever arm is operated. U.S. Pat. No. 4,244,359 also teaches an orthopedic sandal or shoe for correction of hammertoe and halux valgus. A lever arm extends longitudinally along and is pivotally connected to the sole in a rearward portion. A toe holding bar for pressing the toes downward is connected to a free end of the lever arm and various mechanisms associated with the lever arm move the large toe medially for correcting halux valgus. Mechanisms for stretching the large toe in conjunction with intermittent treatment of the halux valgus, are interconnected with the mechanisms for moving the large toe medially. Both of those devices are strictly made for correction of hammertoe and halux valgus and neither have an appearance which make it intended or acceptable for every day wear intermittently with high heel wear.

The only truly corrective shoes are for congenital anomalies in children, or serve to correct individual adult problems, i.e., bunions or arch supports. No device specifically responds to the total array of pathologies of chronic high heel wear, especially an effective combined therapy, which includes the continuation of high heel wear.

SUMMARY OF THE INVENTION

It is accordingly an object of the invention to provide an orthopedic corrective sandal or shoe, which overcomes the hereinafore-mentioned disadvantages of the heretofore-known devices of this general type and which provides an "acceptable" therapeutic device as an alterative to the conventional treatment, which is the "unacceptable" extreme of stopping all high heel wear. A device is presented that corrects or improves the destructive effects of high heel wear, constructed to work "with" continued high heel wear, for wearer acceptance and use.

With the foregoing and other objects in view there is provided, in accordance with the invention, an orthopedic sandal or shoe to be worn intermittently with and to correct the effects of high heel shoe wear. The sandal or shoe comprises a body having an upper surface to be contacted by a foot and a lower surface for contacting a floor. The upper surface provides equalized distribution of pressure without concentration on the heel or balls of the foot and without "arch support", since the arch is elevated above the surface and is not intended to share in correct pressure distribution. The lower surface has a toe area. A multi-point, adjustable, first toe traction system associated with the upper surface provides first toe traction without foot rotation relative to the upper surface. A multi-point, adjustable, foot securing system is associated with the upper surface. A heel support at the upper surface interacts with the foot securing system to eliminate toe gripping and strain. Additionally, a descending two-directional forward slope or domed support may be provided at the upper surface to support and spread the toes and for downward toe deflection to reverse the dorsal-flexing of high heels. An elevated forefoot angulation may be provided at the upper surface for stretching the plantar fascia and Achilles tendon, reversing the contractures and heel spurs of high heels. A rocker bottom may be provided only at the toe area of the lower surface, to reduce dorsal flexion of high heels and allow the first toe to "push off" into the next stride in a normal manner.

Thus, an effective combined therapy which responds to all of the pathologies of chronic high heel wear, which includes the continuation of high heel wear and which is acceptable to the wearer, is provided according to the invention.

In accordance with another feature of the invention, the first toe traction system includes a first bolster medially of the first toe at the upper surface, a second pivot bolster medially of the foot, rearwardly of the first bolster and at the upper surface a pivot point for the first toe and a third counter or lateral traction bolster laterally of the foot, rearwardly of the second pivot bolster and at the upper surface. This system provides three-point adjustable traction for the great toe. A fourth arch bolster may be disposed rearwardly of the second pivot bolster.

In accordance with a further feature of the invention, the foot securing system includes webbings interconnecting the first, second, third and fourth bolsters. Therefore, the foot is held in place facilitating the therapies provided by all of the features of the device. At least three of the webbings are adjustable in length and one, the traction webbing, adjustably wraps around the great toe.

In accordance with an added feature of the invention, there is provided a ring attached to the upper surface and interconnecting the webbings. This provides a central attachment location for the foot securing system.

In accordance with an additional feature of the invention, there is provided an arm extended from the ring between anchor points of the first and second toes. The arm may be hooked at the end.

In accordance with yet another feature of the invention, the upper surface has a recess formed therein for equalizing support at the mid arch. An equalized pressure heel cup and support may also be provided at the upper surface. A maximum support location may be provided at the upper surface at the balls of the foot.

In accordance with a concomitant feature of the invention, the body is formed of foam, which may have regions of varying stiffness, such as three regions disposed one above another or alongside one another, perhaps as circles, between the upper and lower surfaces. The middle region may be the softest. The bolsters may also be formed of a firm bodied foam.

An orthopedic or corrective sandal or shoe is therefore presented for the prevention, delay of symptoms, moderation, correction or relief of the anatomical changes, conditions and pathologies of the foot, caused by chronic high heel wear.

A real life "acceptable" device, allowing positive and beneficial improvements while continuing the high heel use is provided according to the invention. The corrective sandal or shoe or device may be worn before, after or between high heel wear. The device has a combination of features, which specifically oppose and counter the abnormal and destructive angles, distortions and concentrated pressures of the classic high heel. The device provides a unique treatment plan of "off hour" use to combat, control or reverse the mal-effects of chronic high heel use.

The device is directed at wearer acceptance, since a corrective device that is rejected by the wearer is not effective. The device works "with" high heel wear. A real life combined treatment device for comfort and relief is presented.

The invention represents a complete system of counter pressures and positions to insure positive and corrective resistance to the destructive pathological changes of chronic high heel wear.

Other features which are considered as characteristic for the invention are set forth in the appended claims.

Although the invention is illustrated and described herein as embodied in an orthopedic corrective sandal or shoe, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of the specific embodiment when read in connection with the accompanying drawings.

BRIEF DESCRIPTION OF THE DRAWING

FIGS. 9 and 9A-C are respective top-plan and cross-sectional views of the orthopedic corrective sandal or shoe.

DESCRIPTION OF THE PREFERRED EMBODIMENTS

Figure 1:
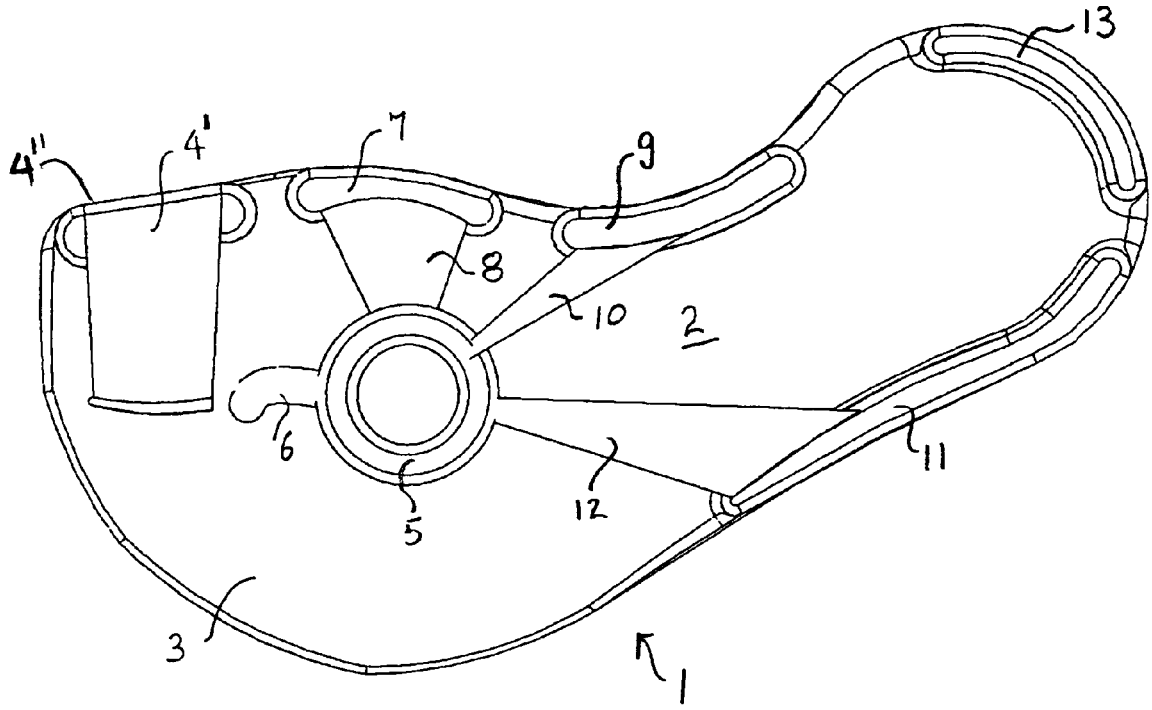
FIG. 1 is a top-plan view of the orthopedic corrective sandal or shoe according to the invention.

Referring now to the figures of the drawings in detail and first, particularly, to FIG. 1 thereof, there is shown a corrective sandal or shoe or device as seen from above. The corrective sandal or shoe or device is provided for correcting the anatomical distortions caused by high heel wear, in which the first toe is forced against and over the second toe, the third toe is abraded against the fourth toe and the fifth toe is crammed under the fourth toe.

The device provides a combination of features which specifically oppose, counter and ensure positive and corrective resistance to the abnormal and destructive angles, distortions and concentrated pressures of chronic high heel wear.

These corrective features include a sandal or shoe body 1 having an upper surface 2 against which the foot rests and a lower surface or sole 25 (shown in FIGS. 2 and 4) at which the sandal or shoe contacts the floor. These surfaces define a foot tray of the device providing a reverse rake or angle as compared to high heels. The forefoot is markedly elevated, stretching the plantar fascia and Achilles tendon. This relaxes the contracted plantar fascia and foot. The foot tray of the device is form fitting, following normal contours, thus allowing and encouraging the foot back into normal alignment. The balls of the foot are supported by a 2½ inch thick super soft broad double arched dome, not only to allow the toes to spread but actually forcing them to separate and relax. The toe support area is sloped down to reverse the dorsal-flexing of high heels, increasing their tendency to spread and return to the normal anatomy. Thus it is seen that the upper surface 2 has a descending and spreading toe slope support 3 for the second, third, fourth and fifth toes, that is the four toes other than the great toe.

The invention includes several bolsters, which are formed of solid foam and have vertical surfaces. A medial toe first bolster 4 is provided as a medial pivot point for first toe traction. The medial toe bolster 4 is a first part of a medial first toe adjustable three-point traction system, the other elements of which will be explained below. A first webbing 4' is in the form of an adjustable strap which may loop under a ring 4" and attach to itself with a hook and eye closure such as VELCRO®. In other words, the first or great toe is provided with traction in the medial direction. The great toe is particularly supported since it takes the brunt of the abuse. The first toe is adjustably tractioned medially, countering hammertoe progression. This medial traction aids the second through fifth toe spreading across the crowning slope.

A ring 5, which may be a cloth strap, is provided for the mutual attachment of several parts of the attachment system. An arm 6 with a crank at the end is provided between anchor points of the first and second toes. The arm 6 is connected to the ring 5. A second or pivot bolster 7 is provided medially of the ring 5 and rearwardly of the adjustable strap 4' of the first bolster 4. The pivot bolster 7 is a second part of the medial first toe adjustable three-point traction system. A second adjustable attachment webbing 8 is connected between the pivot bolster 7 and the ring 5. A third or lateral or counter bolster 11 provides counter support for, and is a third part of, the medial first toe adjustable three-point traction system. Finally, a third adjustable attachment webbing 12 is connected between the lateral bolster 11 and the ring 5. Thus, the four webbings 4', 8, 10 and 12, which may be cloth straps and are connected to the bolsters, provide a four-point adjustable securing system.

Therefore, in addition to the medial toe bolster 4, the medial first toe adjustable three-point traction system is completed by the pivot bolster 7 located just medially to its metatarsal junction and the counter or lateral traction bolster 11 on the opposite side of the foot near the rear. These three elements allow controlled large toe traction, without foot rotation, in relation to the sole of the device.

A fourth or arch bolster 9 is disposed rearwardly of the pivot bolster 7. A fourth adjustable attachment webbing 10 is connected between the arch bolster 9 and the ring 5. At least three of the webbings are adjustable in length.

A heel bolster 13 is provided at the rear of the corrective sandal or shoe. The heel is cushioned both laterally and lineally to aid in pressure sharing and to relieve "pump bump" and heel spurs. The heel bolster, combined with the four-point securing system, allows the device to be worn without toe gripping or strain.

Figure 2:
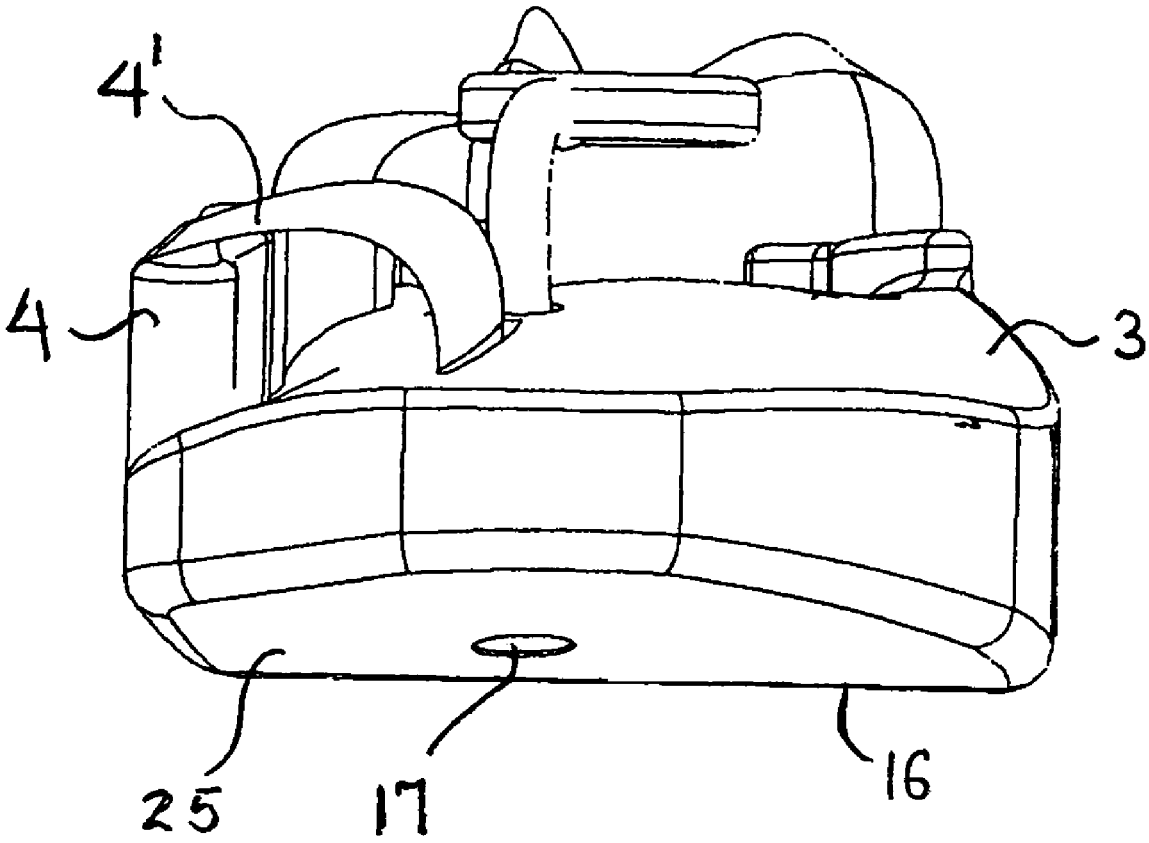
FIG. 2 is a forward-elevational view of the orthopedic corrective sandal or shoe.

The front view of the sandal or shoe shown in FIG. 2 illustrates a rocker surface limited to the toe area 16, which prevents toe over-flexion as the sole rocks forward.

The downward angle of the descending and spreading toe slope support 3 can also be clearly seen in FIG. 2. The toe slope support 3 slopes in the forward and lateral directions from a high point in the center to allow and force spreading of the toes. A space for insertion of the first toe under the strap 4' of the medial first toe bolster 4 can be seen in the figure. An attachment location 17 can also be seen in the sole 25 for the ring 5 for the attachment system.

Figure 3:
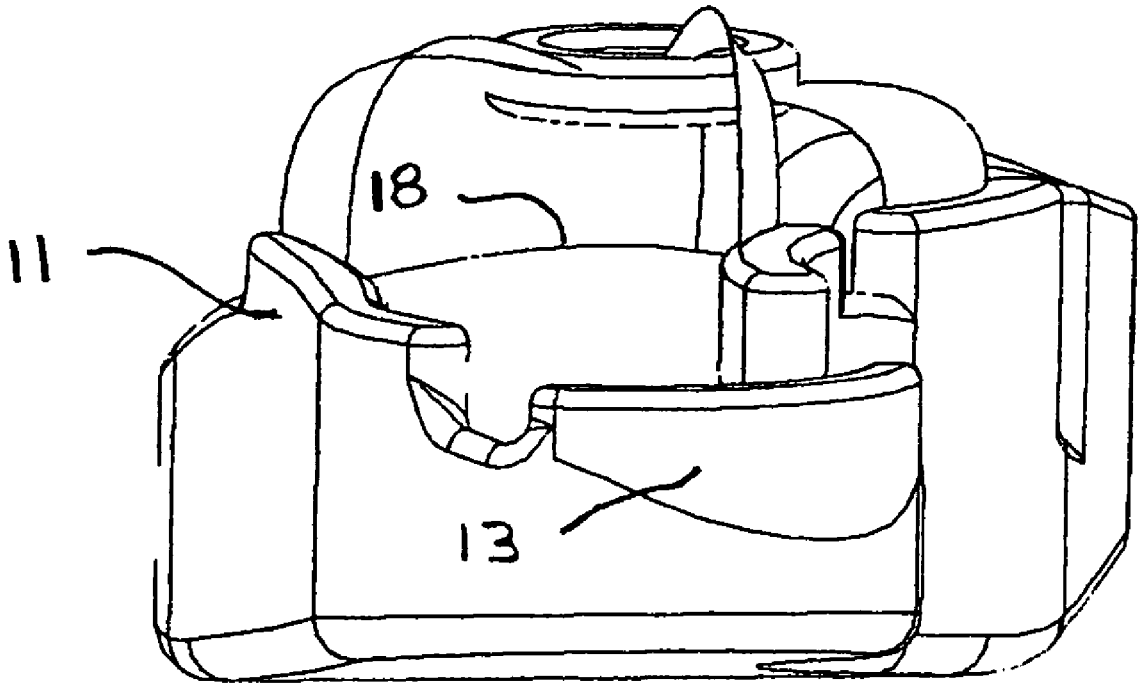
FIG. 3 is a rear-elevational view of the orthopedic corrective sandal or shoe.

FIG. 3, which shows the rear of the sandal or shoe, illustrates the heel bolster 13 as well as the lateral bolster 11. In addition, the apex 18 of the crown or support dome of the toe slope support 3 can be seen as elevating the forward plantar surface, supporting the toe forefoot and forcing the toes to spread and relax.

Figure 4:
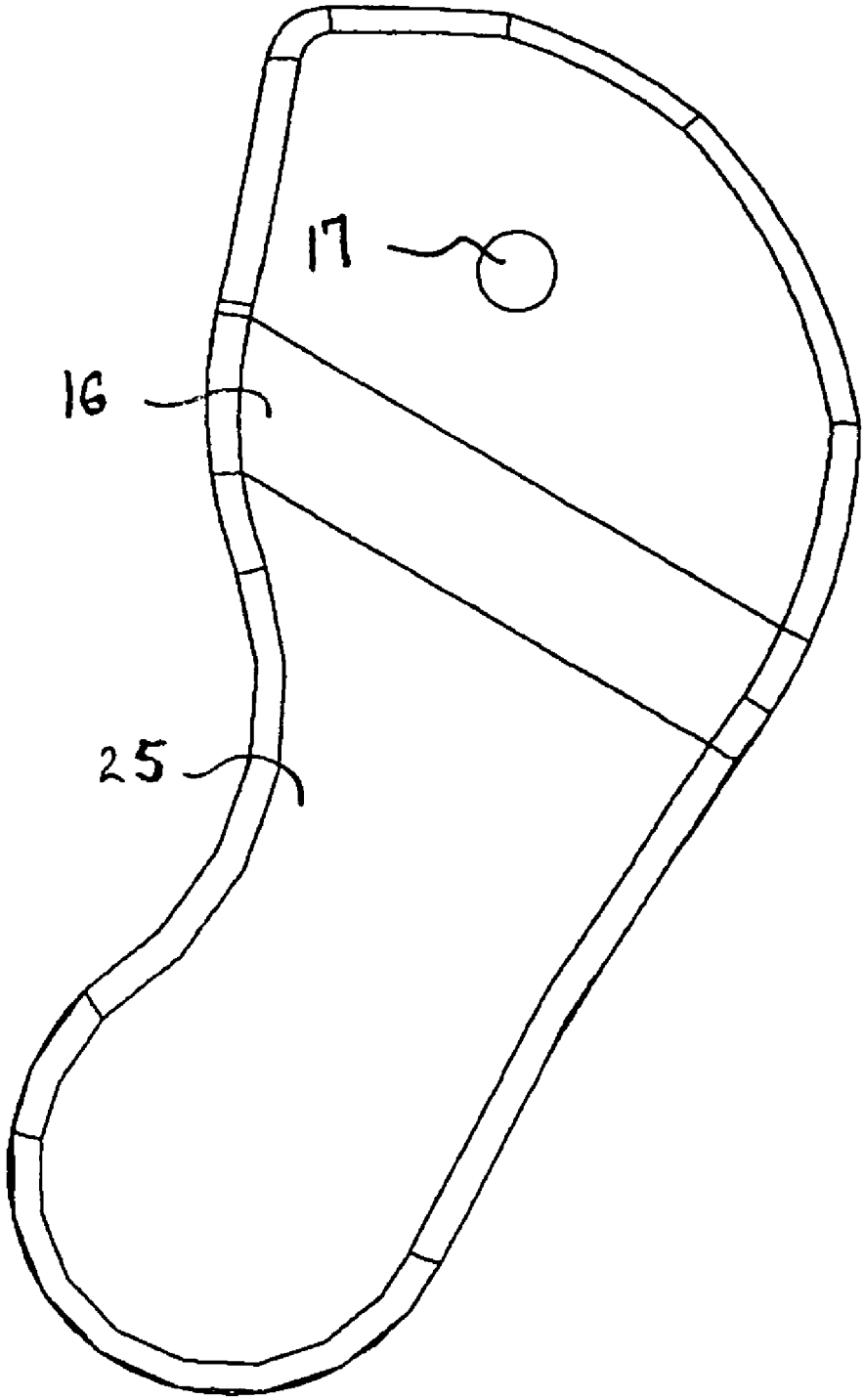
FIG. 4 is a bottom-plan view of the orthopedic corrective sandal or shoe.
Figure 5:
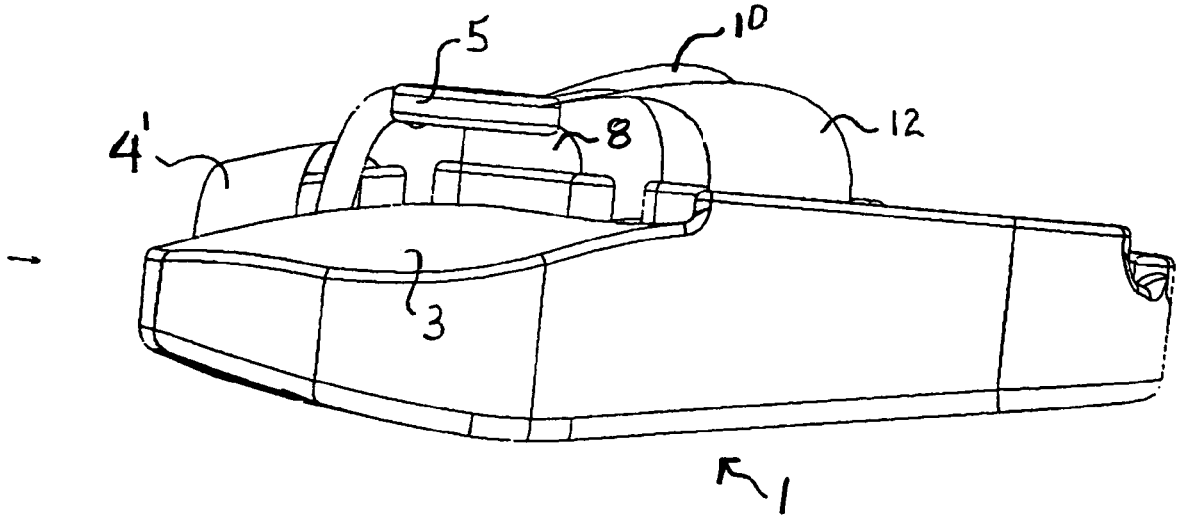
FIG. 5 is a forward and medial-perspective view of the orthopedic corrective sandal or shoe.
Figure 6:
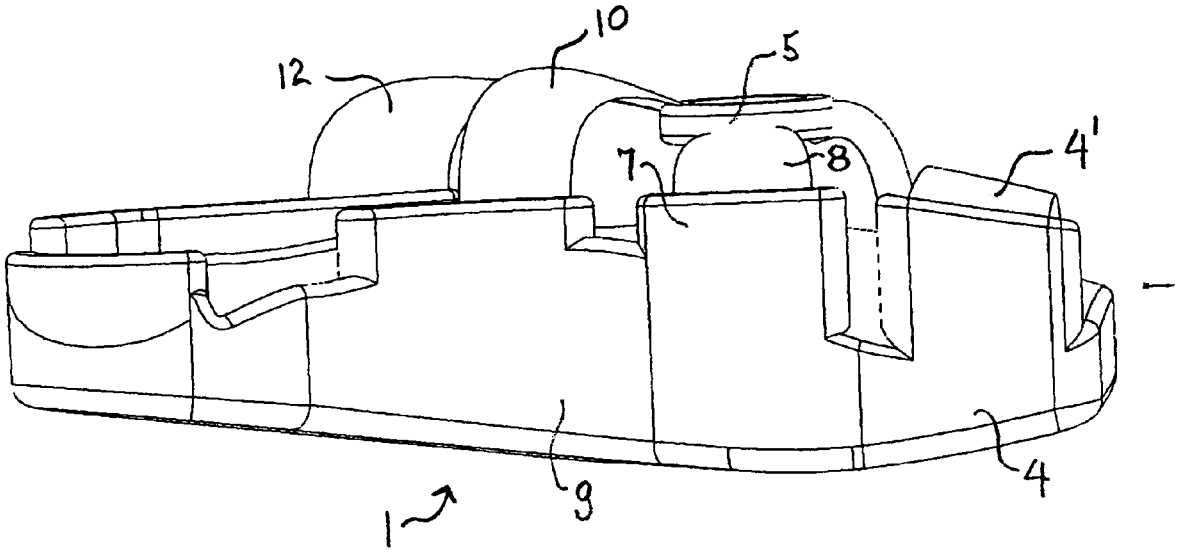
FIG. 6 is a forward and lateral-perspective view of the orthopedic corrective sandal or shoe.
Figure 7:
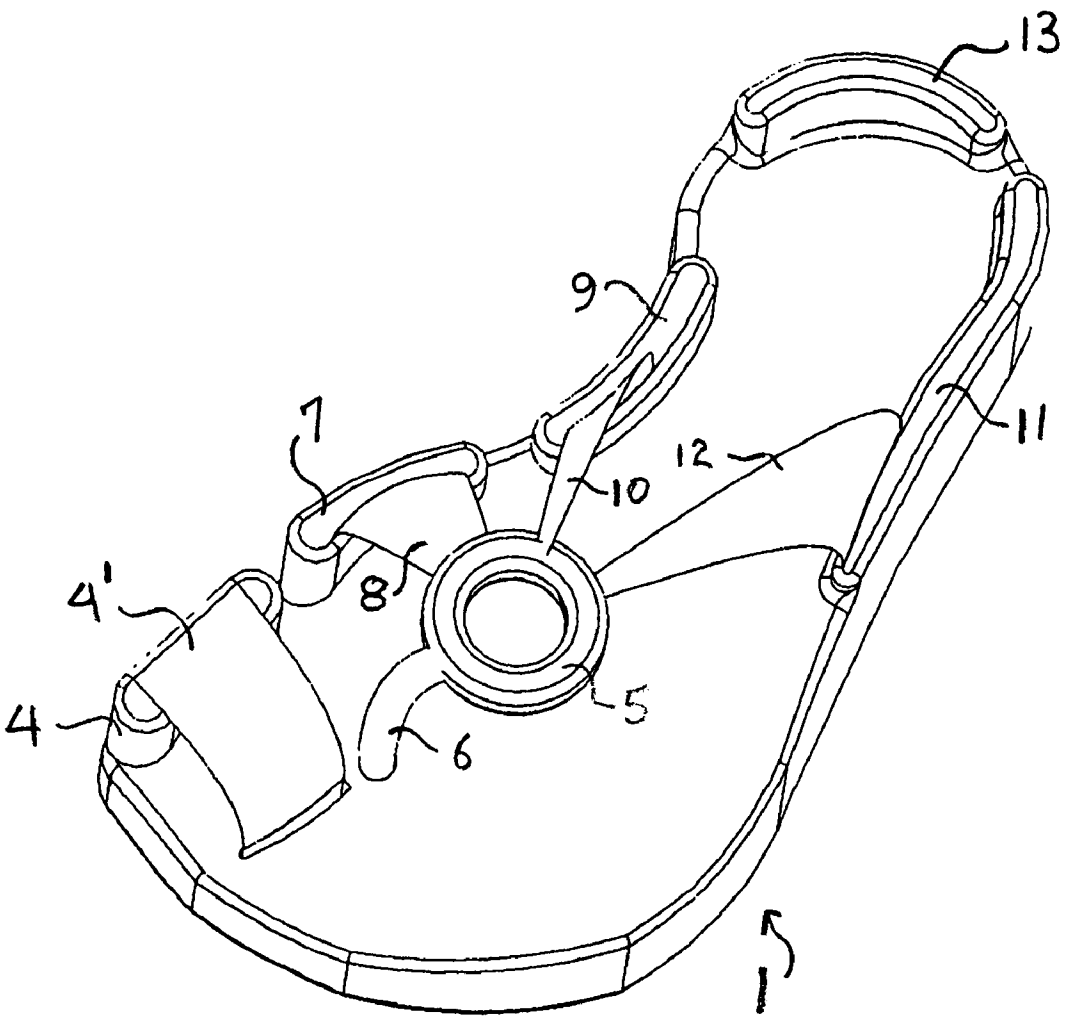
FIG. 7 is a forward, top and lateral-perspective view of the orthopedic corrective sandal or shoe.
Figure 8:
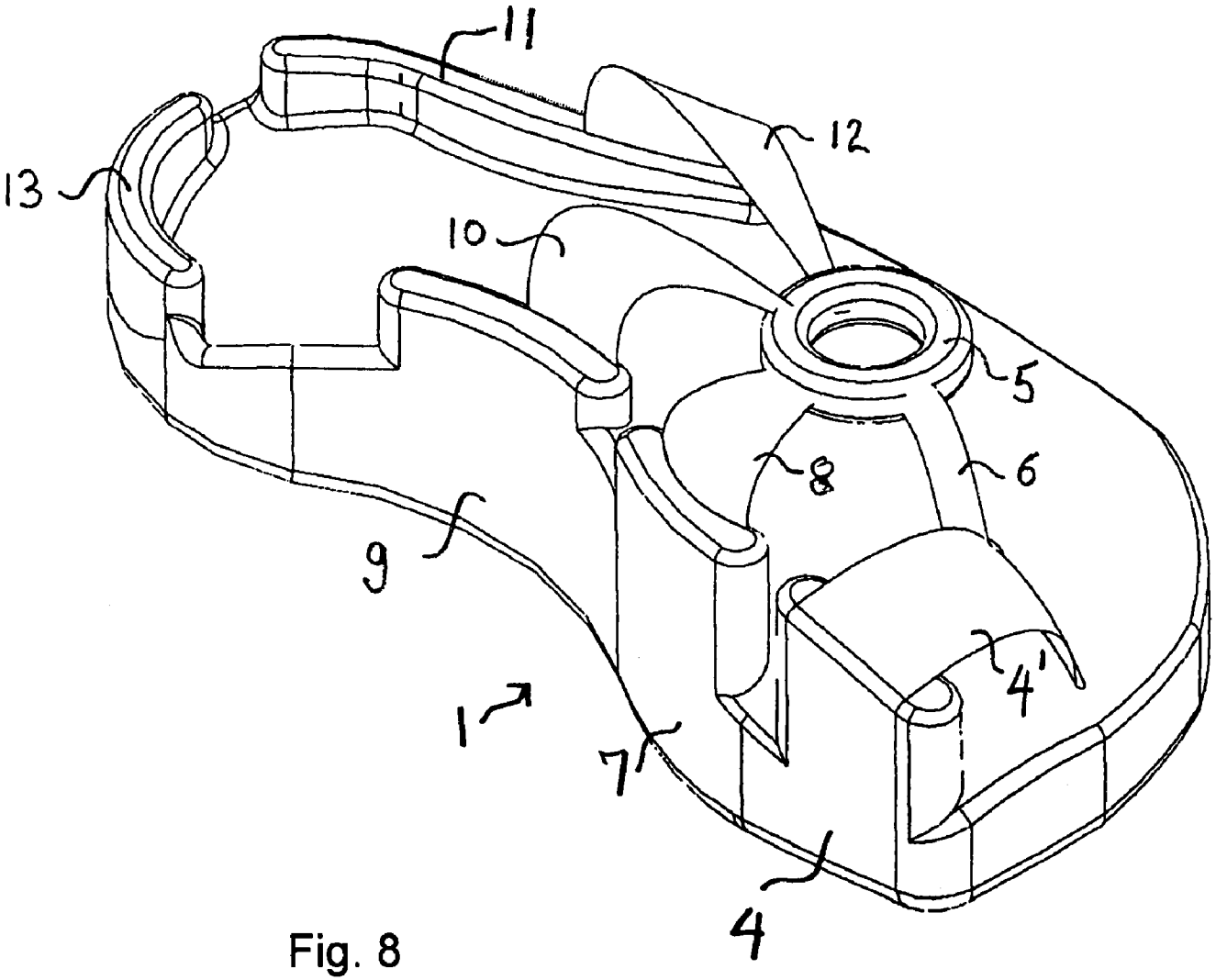
FIG. 8 is a forward, top and medial-perspective view of the orthopedic corrective sandal or shoe.

FIG. 4 shows the corrective sandal or shoe from the bottom, indicating the sole 25, the toe rocker area 16 and the attachment location 17. FIG. 5 shows the medial side of the sandal or shoe body 1, indicating the toe slope support 3, the strap 4' of the medial first toe bolster 4, the ring 5 and the adjustable attachment webbings 8, 10, 12. FIG. 6 shows the opposite or lateral side of the sandal or shoe body 1 illustrating the medial first toe bolster 4, the pivot bolster 7 and the arch bolster 9. The adjustable attachment webbings 8, 10, 12 and the ring 5 are also seen. FIGS. 7 and 8 are respective lateral and medial perspective views of the sandal or shoe body 1, also showing the ring 5, the bolsters 4, 7, 9, 11, 13, the webbings 8, 10, 12, the arm 6 and the strap 4'.

Figure 9:
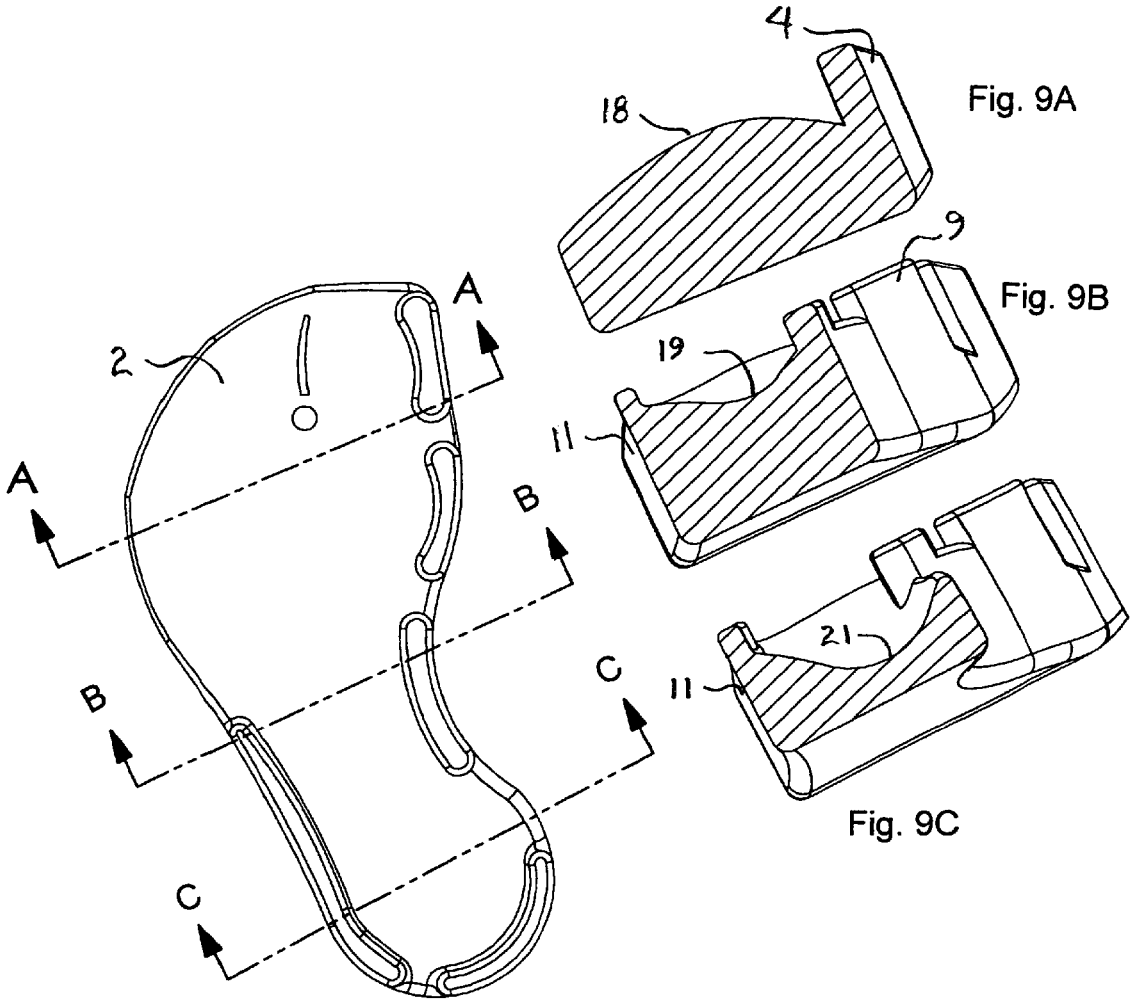

FIG. 9 is a view of the upper surface 2 of the corrective sandal or shoe from above. The ring, arm, bolsters, webbings and strap have been removed in FIG. 9 for clarity. It may be seen that three sectional views of FIG. 9 are illustrated in FIGS. 9A, 9B and 9C. The view of FIG. 9A is taken along a line A-A of FIG. 9, in the direction of the arrows, and shows the apex 18 of the crown or support dome of the toe slope support 3, allowing and forcing the metatarsal to spread and relax. The medial first toe bolster 4 is also seen. The view of FIG. 9B is taken along a line B-B of FIG. 9, in the direction of the arrows, and shows a recess 19 in the upper surface 2 for equalizing support at the mid arch. The recess 19 is disposed between the bolsters 9 and 11. The view of FIG. 9C is taken along a line C-C of FIG. 9, in the direction of the arrows, and shows an equalized pressure heel cup and support 21 medially of the bolster 11.

Figure 10:
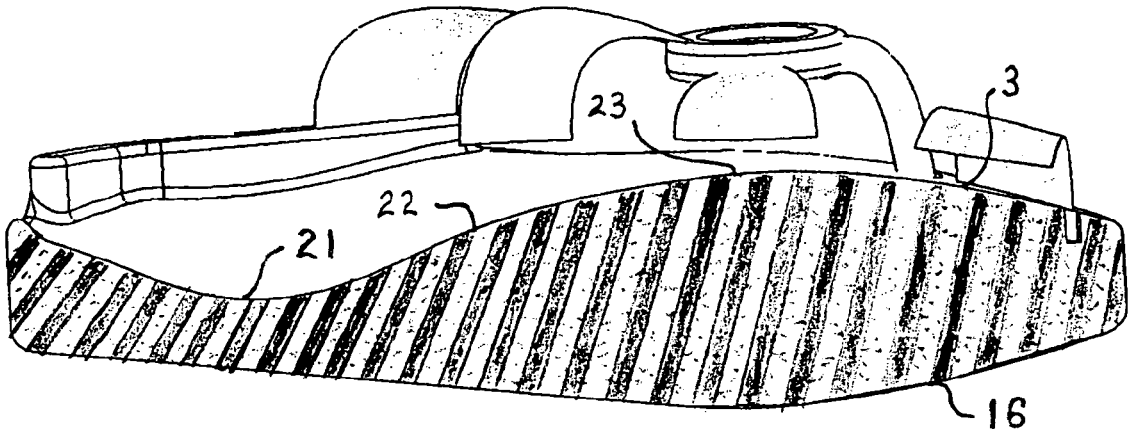
FIG. 10 is a longitudinal-sectional view of the orthopedic corrective sandal or shoe.

FIG. 10 is a longitudinal section of the sandal or shoe body 1 showing the toe rocker area 16, the descending toe slope support 3 and the heel cup and support 21. In addition, the sectional view illustrates an upward angulation 22 of the plantar surface and a maximum support location 23 at the balls of the foot. It may be seen that the corrective sandal or shoe is formed of foam. Although not absolutely necessary, the foam may be provided in three layers or circles of varying stiffness, with the middle layer being the softest.

The combination of features according to the invention provide the following advantages:

1) every anatomic distortion or abnormal pressure concentration of the high heel is correctively countered;
2) injurious contours are reversed;
3) the round "rear" of the heel is presented for impact first;
4) normal pronation is promoted;
5) arch support is not promoted, but even "pressure" is ensured;
6) pronation pressure is spread across the forefoot and encouraged by the domed support;
7) toes are protected from hyperflexion by the toe slope and caused to spread and relax by the double direction slope, with the rocker bottom just under the toe allowing normal "push off";
8) the medial first toe adjustable three-point traction system effectively counters the most destructive influences of high heel wear; and
9) the heel bolster combined with the four-point adjustable attachment system allows secure, comfortable, properly fit and effective wear.

I claim:

1. An orthopedic sandal or shoe to be worn intermittently with and to correct the effects of high heel shoe wear, the sandal or shoe comprising:

a body having an upper surface to be directly contacted by a foot and a lower surface for contacting a floor, said upper surface having contours providing equalized counter pressures for correcting foot distortions without concentration on the heel or balls of the foot by placing the balls higher than the heel to provide reduced arch support;

a multi-point, adjustable, first toe traction system above said upper surface for providing first toe traction and therapeutic over-corrective lateral pressure without foot rotation relative to said upper surface;

a multi-point, adjustable, foot securing system above said upper surface permitting effective therapeutic correction and preventing movement and providing equal retainment pressure of the foot; and a heel support at said upper surface interacting with and countering said foot securing system to eliminate toe gripping and strain.

2. The orthopedic corrective sandal or shoe according to claim 1, which further comprises a descending, double slope or dome support at said upper surface for supporting and spreading the toes and for downward toe deflection to reverse dorsal-flexing.

3. The orthopedic corrective sandal or shoe according to claim 1, which further comprises an elevated forefoot angulation at said upper surface for stretching the plantar fascia and Achilles tendon.

4. The orthopedic corrective sandal or shoe according to claim 1, which further comprises a rocker bottom only at a toe area of said lower surface.

5. The orthopedic corrective sandal or shoe according to claim 1, wherein said first toe traction system includes:

a first bolster medially of the first toe at said upper surface;

a second pivot bolster medially of the foot, rearwardly of said first bolster and at said upper surface; and a third counter or lateral traction bolster laterally of the foot, rearwardly of said second pivot bolster and at said upper surface.

6. The orthopedic corrective sandal or shoe according to claim 5, which further comprises a fourth arch bolster disposed rearwardly of said second pivot bolster.

7. The orthopedic corrective sandal or shoe according to claim 5, wherein said foot securing system includes webbings interconnecting said first, second, third and fourth bolsters.

8. The orthopedic corrective sandal or shoe according to claim 7, which further comprises a ring attached to said upper surface and interconnecting said webbings.

9. The orthopedic corrective sandal or shoe according to claim 8, which further comprises an arm extended from said ring between anchor points of the first and second toes.

10. The orthopedic corrective sandal or shoe according to claim 7, wherein all of said webbings are adjustable in length.

11. The orthopedic corrective sandal or shoe according to claim 7, wherein one of said webbings adjustably wraps around the great toe.

12. The orthopedic corrective sandal or shoe according to claim 1, wherein said upper surface has a recess formed therein for equalizing support at the mid arch.

13. The orthopedic corrective sandal or shoe according to claim 1, which further comprises an equalized pressure heel cup and support at said upper surface.

14. The orthopedic corrective sandal or shoe according to claim 1, which further comprises a maximum support location at said upper surface at the balls of the foot.

15. The orthopedic corrective sandal or shoe according to claim 1, wherein said body is formed of foam.

16. The orthopedic corrective sandal or shoe according to claim 15, wherein said foam has regions of varying stiffness.

17. The orthopedic corrective sandal or shoe according to claim 5, wherein said bolsters are formed of foam.

18. The orthopedic corrective sandal or shoe according to claim 2, wherein said descending, double slope or dome support at said upper surface descends continuously.

19. An orthopedic sandal or shoe to be worn intermittently with and to correct the effects of high heel shoe wear, the sandal or shoe comprising:

a body having an upper surface to be directly contacted by a foot and a lower surface for contacting a floor, said upper surface having contours providing equalized counter pressures for correcting foot distortions without concentration on the heel or balls of the foot by placing the balls higher than the heel to provide reduced arch support;

a first toe traction system above said upper surface for providing first toe traction and therapeutic over-corrective lateral pressure without foot rotation relative to said upper surface;

a foot securing system above said upper surface permitting effective therapeutic correction and preventing movement and providing equal retainment pressure of the foot;

a heel support at said upper surface interacting with and countering said foot securing system;

a descending toe support at said upper surface;

an elevated forefoot angulation at said upper surface; and a rocker bottom at said lower surface.

* * * * *